US005331390A

United States Patent [19]

Kimura et al.

[11] Patent Number: 5,331,390

[45] Date of Patent: Jul. 19, 1994

[54] IMAGE FORMING EQUIPMENT HAVING A REVOLVER TYPE DEVELOPING DEVICE

[75] Inventors: Noriyuki Kimura, Kawasaki; Minour Suzuki, Yokohama, both of Japan

[73] Assignee: Ricoh Company, Ltd., Tokyo, Japan

[21] Appl. No.: 53,674

[22] Filed: Apr. 29, 1993

[30] Foreign Application Priority Data

Apr. 30, 1992 [JP] Japan ..... 4-110974

[51] Int. Cl.[5] ..... G03G 15/01

[52] U.S. Cl. ..... 355/326 R; 346/157; 355/327

[58] Field of Search ..... 355/326 R, 327, 245, 355/215, 328; 346/157

[56] References Cited

U.S. PATENT DOCUMENTS

| | | | |
|---|---|---|---|
| 3,987,756 | 10/1976 | Katayama et al. | 355/327 X |
| 4,030,445 | 6/1977 | Takenaga et al. | 355/326 X |
| 4,620,783 | 11/1986 | Tanaka et al. | 355/326 X |
| 4,622,916 | 11/1986 | Tanaka et al. | 355/345 X |
| 4,697,915 | 10/1987 | Hayashi et al. | 355/327 |
| 4,743,938 | 5/1988 | Ohuo | 355/327 |
| 4,782,360 | 11/1988 | Iwamoto et al. | 355/326 |
| 4,792,825 | 12/1988 | Saito et al. | 355/245 |
| 4,922,301 | 5/1990 | Katoh et al. | 355/326 X |
| 4,933,727 | 6/1990 | Mizuma et al. | 355/327 |
| 4,939,548 | 7/1990 | Yamada et al. | 355/245 |
| 5,160,969 | 11/1992 | Mizuma et al. | 355/326 |
| 5,168,319 | 12/1992 | Kimura et al. | 355/326 |
| 5,198,866 | 3/1993 | Kimura et al. | 355/326 |
| 5,258,819 | 11/1993 | Kimura et al. | 355/326 R |

FOREIGN PATENT DOCUMENTS

| | | | |
|---|---|---|---|
| 0093079 | 6/1983 | Japan | 355/327 |
| 0172660 | 10/1983 | Japan . | |
| 0162271 | 8/1985 | Japan . | |
| 0208779 | 10/1985 | Japan . | |
| 0071981 | 4/1987 | Japan . | |
| 0127873 | 6/1987 | Japan | 355/215 |
| 0283363 | 12/1987 | Japan | 355/215 |
| 0316068 | 12/1988 | Japan | 355/327 |
| 0257871 | 10/1989 | Japan | 355/326 |
| 0068970 | 3/1991 | Japan | 355/326 |
| 0029166 | 1/1992 | Japan | 355/326 |

*Primary Examiner*—Matthew S. Smith

*Attorney, Agent, or Firm*—Oblon, Spivak, McClelland, Maier & Neustadt

[57] ABSTRACT

Image forming equipment of the type having a revolver type or rotational developing device. The revolver type developing device is rotatable about a shaft to bring any one of a plurality of developing units to a developing position where the developing unit faces an image carrier for effecting development. A protective member rotatably accommodates the developing device therein and has an opening which faces the image carrier at the developing position when the protective member is mounted on the equipment. Rotation restricting means is provided for selectively inhibiting the developing device from rotating relative to the protective member.

16 Claims, 17 Drawing Sheets

IMAGE FORMING EQUIPMENT HAVING A REVOLVER TYPE DEVELOPING DEVICE

BACKGROUND OF THE INVENTION

The present invention relates to image forming equipment having a revolver type developing device which accommodates a plurality of developing units therein.

A full color copier belongs to a family of image forming equipment of the type electrostatically forming latent images on a photoconductive element, or image carrier, by exposure to color separated light images, developing each latent image by a toner complementary in color to the associated light image, and transferring the resulting toner images to a single sheet one above the other. Also available in the imaging art is multicolor image forming apparatus which forms latent images to be developed in different colors one by one on an image carrier, develops them by developers of different colors, and transfers the resulting toner images to a single sheet. While these types of image forming equipment need a plurality of developing units, the developing units undesirably scale up the equipment when constructed independently of each other and arranged around the image carrier.

A revolver type or rotary developing device is an implementation elaborated to solve the above problem. This type of developing device has a rotatable hollow cylindrical casing facing an image carrier and accommodating a plurality of developing units at predetermined positions therein. The casing is rotated to sequentially locate the developing units at a developing position. As a result, latent images formed on the latent image are each developed by a toner of particular color.

Generally, black-and-white and other monocolor documents are predominant over the others so long as a copier, for example, is operated in an ordinary situation. Hence, a black toner, among the others, is consumed more than the others. The above-stated revolver type developing device cannot accommodate more than a predetermined amount of toner in each developing due to the particular construction. Since this type of device bodily rotates about its own axis, it is difficult to connect a large capacity toner container to the device. Further, while a toner of particular color is consumed more than the others, supplementing the toner from the outside each time is troublesome. In the light of this, Japanese Patent Laid-Open Publication No. 71981/1987, for example, discloses a copier loaded with a monocolor, e.g., black developing device during ordinary copying operation or with a revolver type developing device during color copying. While the copier of this Laid-Open Publication stores toners of two different colors, e.g., red and blue to implement a bicolor or so-called multicolor image, this is also true with a greater number of colors or with a full color developing device storing yellow, magenta and cyan toners.

The spread of copiers and other image forming equipment has given rise to a tendency to entrust ordinary users with, for example, the replacement of units and an image forming device accommodating a plurality of units. Then, the easy and safe replacement of the units and device and the easy handling of substitute units and device are have to be promoted.

Regarding the revolver, each unit may be mounted and dismounted independently of the other units at the front or the top of the equipment body, as taught in, for example, Japanese Patent Laid-Open Publication Nos. 208779/1985 and 127850/1987. Handling the units one by one as mentioned is desirable for the replacement or maintenance of a single unit. However, this kind of approach is not adequate when the units have to be replaced to selectively implement a black-and-white image or a color image.

A plurality of units may be constructed into a single developing device which is bodily removable from the equipment body, as disclosed in Japanese Patent Laid-Open Publication No. 78170/1988 by way of example. This kind of scheme allows a plurality of units to be replaced by a single operation. However, since the units are pulled out at the front of the equipment body, a mechanism for spacing the units apart from the photoconductive element is needed. Moreover, to fully mount or dismount the units, slide rails and guides are indispensable in helping the units slide in the longitudinal direction. Consequently, there are needed a mechanism which promotes smooth mounting and dismounting of the developing device, and a rigid and reliable mechanism which prevents the units from dropping and losing their functions, protects the surroundings and operator from smears due to the toners, and frees the operator from the fear of injury. Such mechanisms are complicated and expensive to increase the cost of the overall equipment.

Further, to pull out the units at the front of the equipment, the front panel of the equipment body has to be formed with an opening greater than the diameter of one unit and is, therefore, mechanically weak. Such a front panel cannot be made thin or has to be provided with a reinforcing member. In addition, the opening has to be provided with a mechanism or a member for positioning the front side of the unit relative to the photoconductive element, further increasing the cost and complicating the mounting and dismounting operation.

The conventional schemes described above have a drawback that the toners are apt to leak from the developing units other than one located at the developing position, contaminating optics, among others, and causing undesirable color mixture to occur. The developer carrier is exposed to the outside via the opening of the casing and, therefore, likely to scratch or otherwise damage the surface of the photoconductive element. Moreover, when the developing device is left at the outside of the equipment or transported, dust, paper dust and other impurities are apt to enter the developing device via the opening to lower image quality and damage the constituent parts.

To eliminate the contamination and color mixture, a cover member or similar screen member having an opening may surround the revolver, as proposed by, for example, Japanese Patent Laid-Open Publication Nos. 172660/1983 and 162271/1985. However, this kind of approach is not satisfactory since the revolver is rotatably supported by the cover member. Specifically, when the revolver is removed from the equipment body and, therefore, brought out of the developing position, the revolver rotates about its own axis relative to the cover member in a pendulum fashion such that the center of gravity thereof is brought to the lowest position. This kind of motion is particularly conspicuous with the unit being used or having been used since the amount of toner consumption in such a unit sharply changes. Assume that such a motion occurs when the user or the serviceman takes out the revolver from the equipment body for a given purpose. Then, the center of gravity of the entire revolver, including the cover member, is shifted to bring the revolver out of balance. As a result, the revolver is likely to fall or contact adjoining devices. This is also true when the revolver is transported, e.g., packages of such revolvers are apt to collapse in the event of shipment.

The prerequisite with the above-described type of revolver is that it be rotated to and held at a predetermined developing position at the time of image formation. To meet this requirement, the revolver is usually brought to a reference position (home position) and then stopped there prior to image formation. However, when the revolver moves in the above-stated manner relative to the cover member after the removal from the equipment body, the position of the revolver relative to the center of rotation becomes arbitrary. Then, when the revolver is inserted into the equipment again, the revolver has to be rotated to the reference position, wasting much time and cost. In addition, the increase in the time and distance for the revolver to reach the reference position aggravates the probability of erroneous detection of the reference position.

SUMMARY OF THE INVENTION

It is therefore an object of the present invention to provide image forming equipment which prevents a revolver type developing device thereof from rotating by accident with a simple construction, promotes easy handling of units at the outside of the equipment, and eliminates troubles during transport.

Image forming equipment of the present invention comprises an image carrier, a revolver type developing device rotatable about a shaft to bring any one of a plurality of developing units to a developing position where the developing unit faces the image carrier for effecting development, a protective member rotatably accommodating the developing device therein and having an opening which faces the image carrier at the developing position when the protective member is mounted on the equipment, and rotation restricting means for selectively inhibiting the developing device from rotating relative to the protective member.

BRIEF DESCRIPTION OF THE DRAWINGS

The above and other objects, features and advantages of the present invention will become more apparent from following detailed description taken with the accompanying drawings in which.

In the figures, the same or similar constituent parts are designated by the same reference numerals.

DESCRIPTION OF THE PREFERRED EMBODIMENTS

Figure 2:
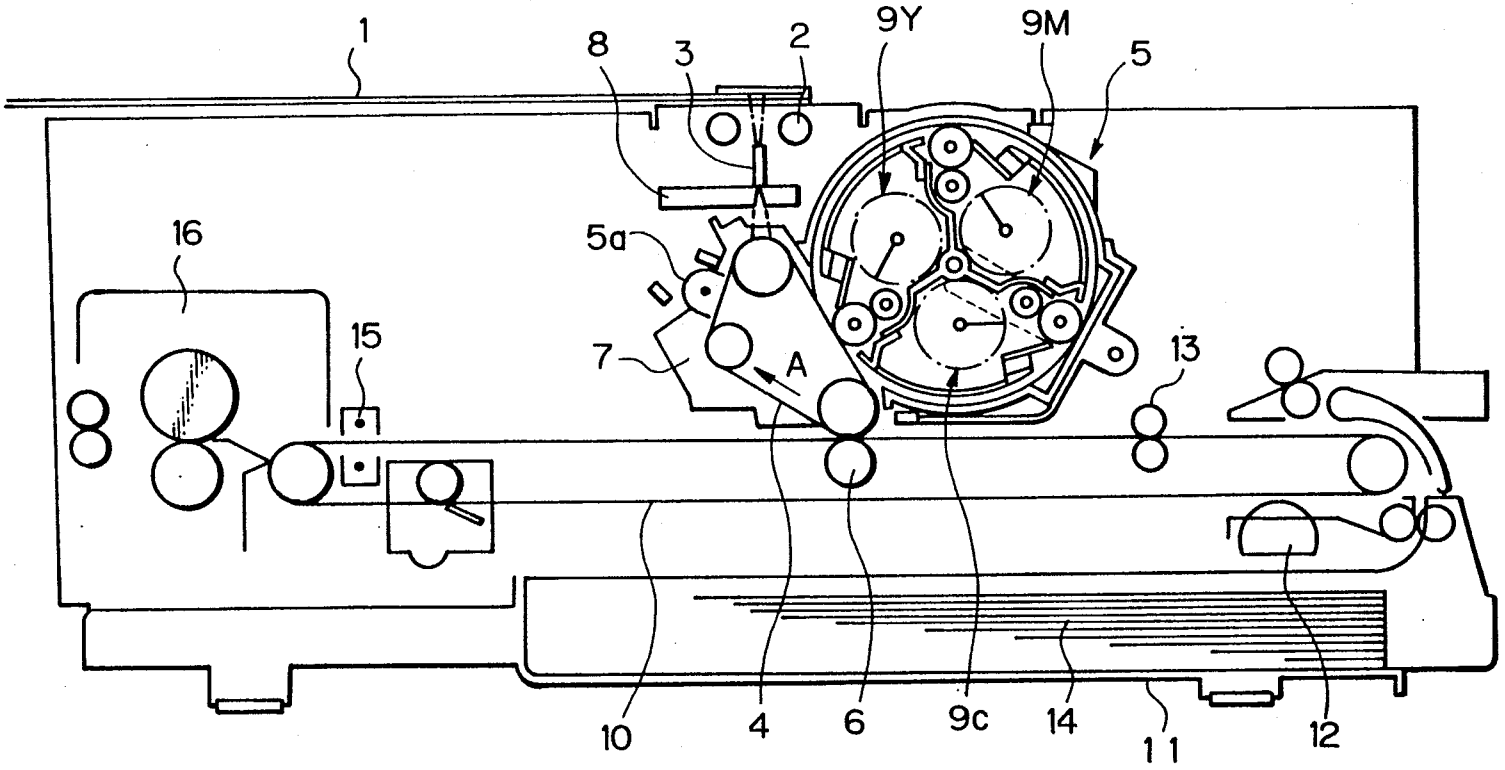
FIG. 2 is a section showing the general construction of the equipment.

Referring to FIG. 2 of the drawings, image forming equipment with a revolver type developing device to which the present invention is applicable is shown and implemented as a full color copier. As shown, the copier has a platen movable in the right-and-left direction with a document laid thereon. When the document is brought to a predetermined position, a lamp 2 illuminates it through a slit. The resulting reflection from the document is focused onto a photoconductive element, or image carrier, implemented as a belt 4 via a rod lens array 3. At this instant, a subscan drive mechanism, not shown, moves the platen 1 and belt 4 in synchronism. As a result, a latent image is electrostatically formed on the belt 4 which has been uniformly charged by a main charger 5*a*. A revolver type developing device 5, a transfer roller 6, a cleaning unit 7 and so forth which will be described are sequentially arranged around the belt 4 in a direction of rotation indicated by an arrow A in the figure. Filters 8 of three primary colors, i.e., blue, green and red are replaceably disposed on the optical path for exposure. latent images each being formed via respective one of the three color filters 8 are developed by yellow, magenta and cyan developing units $9_Y$, $9_M$ and $9_C$ accommodated in the revolver 5.

In an image transfer section, a transport belt 10 is passed over the transfer roller 6. A sheet 14 is fed from a tray 11 toward a register roller 13 by a pick-up roller 12 and then to the transport belt 10. As the transport belt 10 is moved in the right-and-left direction as viewed in the figure in a reciprocating motion while carrying the sheet 14 thereon, toner images of three colors are sequentially transferred from the belt 4 to the sheet one above the other. As a result, a full color image is formed on the sheet 14. Thereafter, the sheet 14 is discharged together with the belt 10 by a discharger 15 and thereby separated from the belt 10. Finally, the image on the sheet 14 is fixed by a fixing device 16 to produce a full color copy.

A reference will be made to FIG. 3 for describing the construction and operation of the revolver type developing device or revolver 5 in detail. As shown, the revolver 5 has a hollow cylindrical casing 20 rotatable about a shaft 21. The casing 20 is rotated in a direction B by a drive transmission mechanism which will be described. Three partitions 21*a* extend radially outward from the shaft 21 to form the previously mentioned developing units $9_Y$, $9_M$ and $9_C$.

Figure 3:
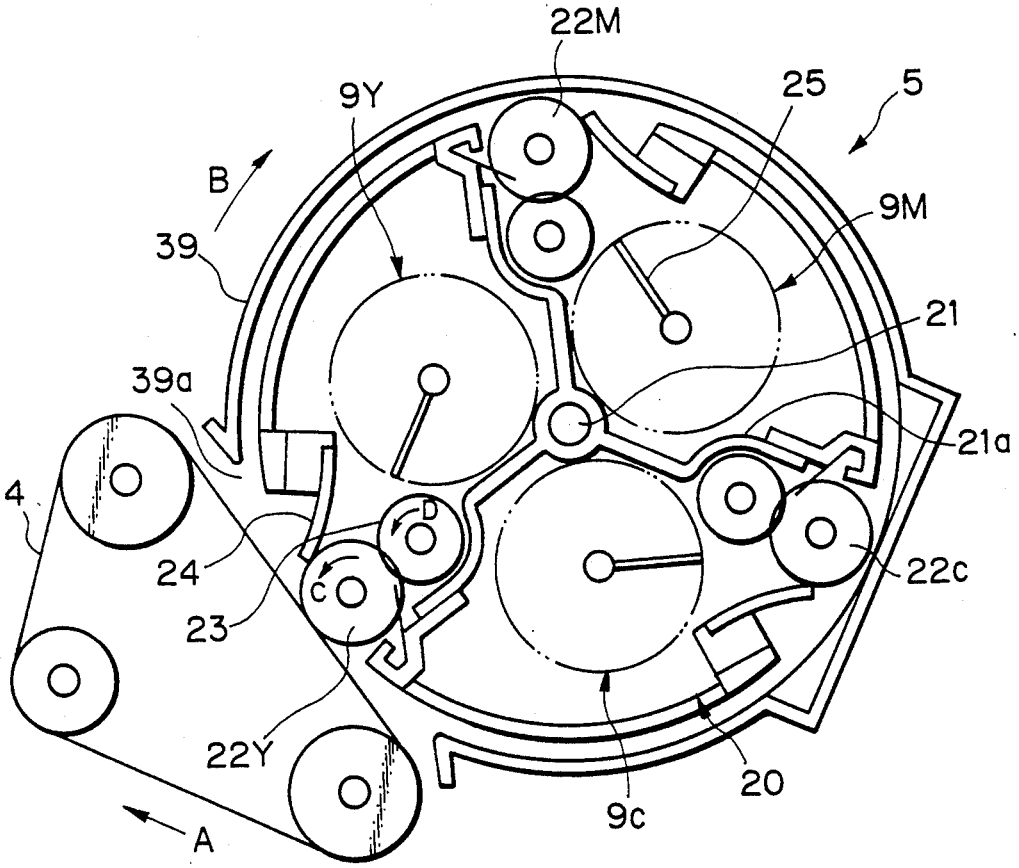
FIG. 3 is an enlarged section showing the developing device.

In the arrangement shown in FIGS. 2 and 3, the developing unit 9Y is shown as being located at a developing position. The developing units $9_Y$, $9_M$ and $9_C$ accommodate respective developing rollers, or developer carriers, $22_Y$, $22_M$ and $22_C$ therein. The developing rollers $22_Y$, $22_M$ and $22_C$ are each partly exposed to the outside via a respective opening formed through the casing 20. A drive transmission mechanism which will be described causes the rollers $22_Y$, $22_M$ and $22_C$ to rotate in a direction C as viewed in the figure.

In the illustrative embodiments, the developing units 9Y, 9M and 9C respectively store yellow, magenta and cyan toners, i.e., non-magnetic one component developers. The units $9_Y$, $9_M$ and $9_C$ are selectively rotated about the shaft 21 to the developing position to sequentially develop latent images formed on the belt 4. The developed images are transferred to the sheet 14 one after another and in register, forming a full color image on the sheet 14.

A supply roller 23 is pressed against each of the developing rollers $22_Y$, $22_M$ and $22_C$ and made of foam polyurethane or similar elastic material. The supply roller 23 is rotated in a direction D by a drive transmission mechanism, which will be described, to supply the toner to the associated developing roller 22 while charging it by friction. A blade 24 is located downstream of the supply roller 23 with respect to the direction C and also made of foam polyurethane or similar elastic material. One end of the blade 24 is pressed against the associated developing roller 22 to regulate the thickness of a toner layer formed on the roller 22. Further, an agitator 25 is disposed in each of the developing units $9_Y$, $9_M$ and $9_C$ and rotated by a drive mechanism, not shown. The revolver 5 is rotatably disposed in a hollow cylindrical cover 39 together with the shaft 21. The cover or protector 39 is formed with an opening 39*a* which faces the belt 4 at the developing position.

Figure 4A:
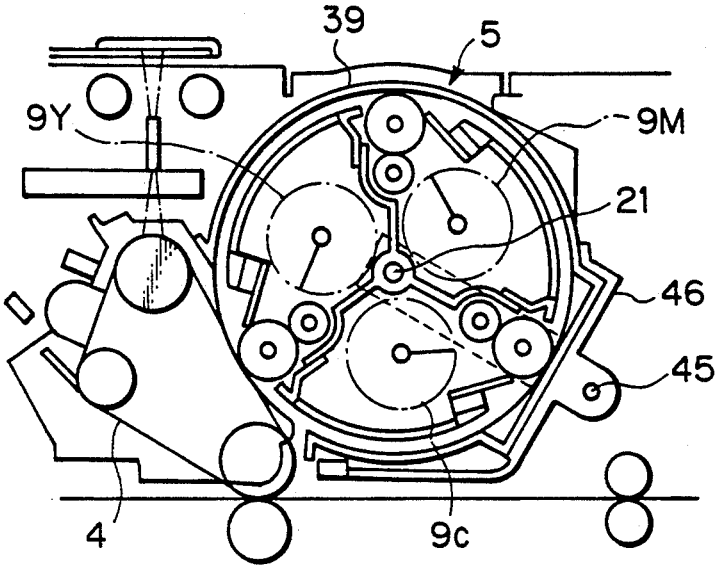
FIGS. 4A-4C are sections each showing a mechanism for mounting and dismounting the revolver in a particular condition.

In this embodiment, the revolver 5 is removably mounted on the copier body together with the cover 39 by a mechanism which will be described with reference to FIGS. 4A–4C. As shown, a shaft 45 is mounted on the copier body in the vicinity of the lower end of the revolver 5 to allow the revolver 5 to move in a pivoting motion. Specifically, a rotatable arm member 46 is supported by the shaft 45 at the lower end thereof. As shown in FIG. 4C, a guide slot 46*a* is formed through the arm member 46 and open at the upper end thereof to receive the shaft 21 in the up-and-down direction. An auxiliary arm 46*b* extends out from the arm member 46 to support part of the revolver 5. A guide member 47 is fixed in place at the inside of each of opposite side walls of the copier body and formed with a slot-like engaging portion 47*a*. The engaging portion 47*a* has an arcuate configuration whose center is located at the shaft 45. The engaging portion 47*a* is so configured as to guide the shaft 21 toward and away from the belt 4. The lower end of the engaging portion 47*a* is positioned such that when the shaft 21 reaches it, the revolver 5 is positioned relative to the belt 4 and copier body and the weight of the revolver 5 acts on it.

Figure 4B:
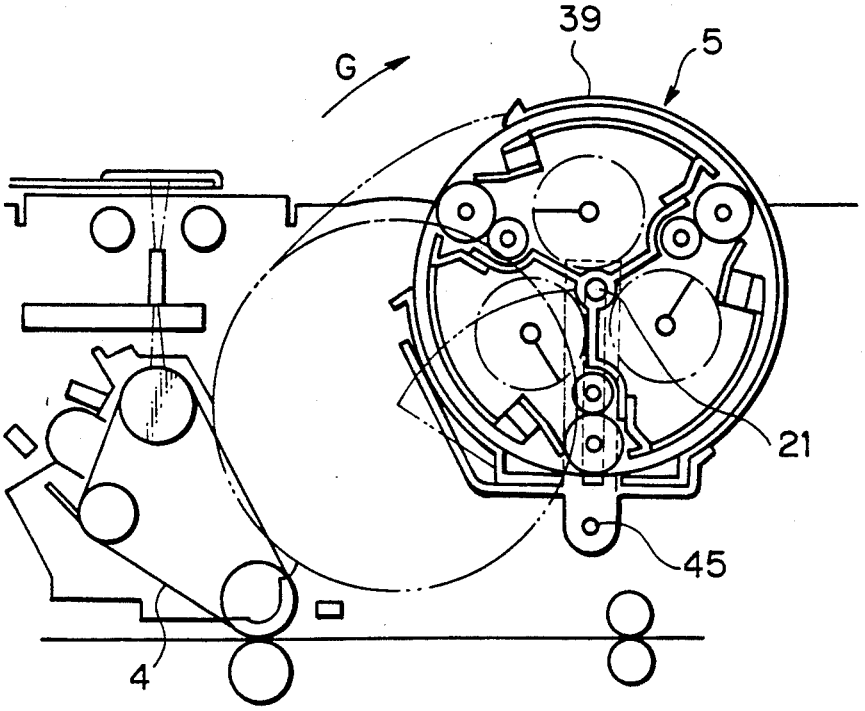
Figure 4C:
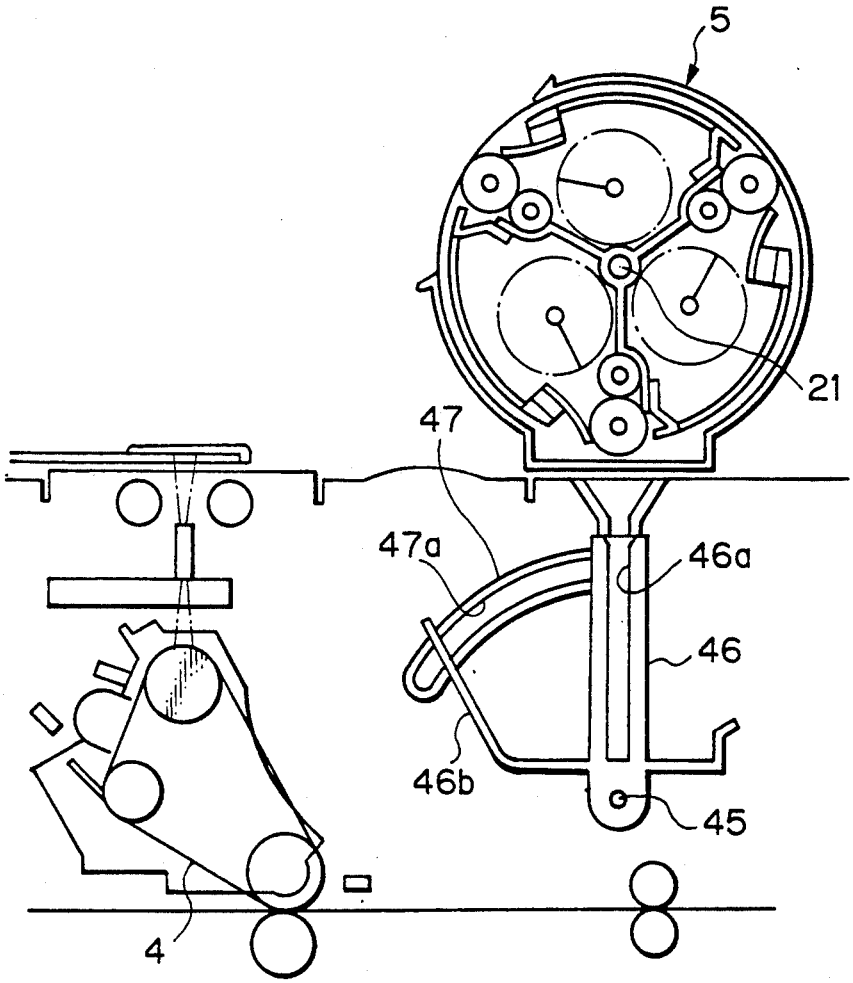

To remove the revolver 5 for a particular purpose, i.e., for the replacement of any of the developing units, the revolver 5 is rotated about the shaft 45, as shown in FIGS. 4B and 4C. At this instant, the shaft 21 moves along the slot 47*a* of the guide member 47 away from the belt 4 (direction G) while being supported by the upper end of the guide slot 46*a*. On reaching a position substantially vertically above the shaft 45, the shaft 21 is brought to a stop. In this condition, the revolver 5 is taken out from the copier body in the substantially vertical direction. To mount the revolver 5 on the copier body, the above procedure is performed in the reverse way. Then, the shaft 21 abuts against the lower end of the engaging portion 47*a* of the guide member 47, thereby positioning the revolver relative to the belt 4. While the weight of the revolver 5 suffices to maintain the revolver 5 stable, an auxiliary stop, not shown, may be used, if desired.

The embodiment having the removable revolver 5 as stated above achieves various advantages as enumerated below.

(1) The revolver 5 accommodating the developing units $9_Y$, $9_M$ and $9_C$ can be easily mounted and dismounted by a single action.

(2) When the revolver 5 is mounted or dismounted, it moves substantially simply toward or away from the belt 4, both the belt 4 and the developing roller 22 are prevented from being scratched or otherwise damaged while the toner is prevented from being scattered around. This is achievable without resorting to a complicated mechanism or a complicated procedure.

(3) The revolver 5 can be positioned by a simple arrangement and a minimum of parts and, therefore, with high accuracy.

(4) The revolver 5 is mounted and dismounted from the upper portion of the copier body. This eliminates the need for slide rails particular to a front loading system and guide members for preventing the revolver 5 from falling. In addition, when the revolver 5 is inserted into the copier body, it can be surely positioned without resorting to a positioning plate or a positioning operation.

Figure 5:
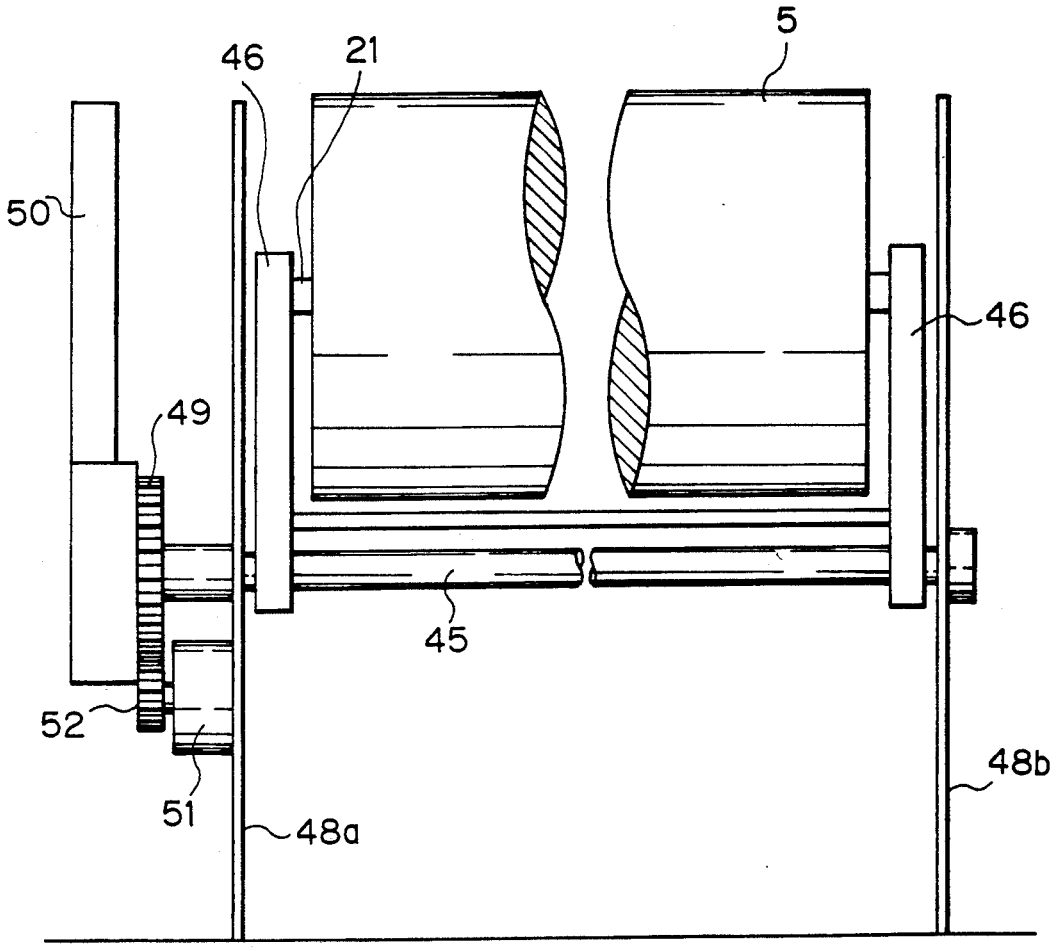
FIG. 5 is a side elevation showing a modified form of the mounting and dismounting mechanism.
Figure 6:
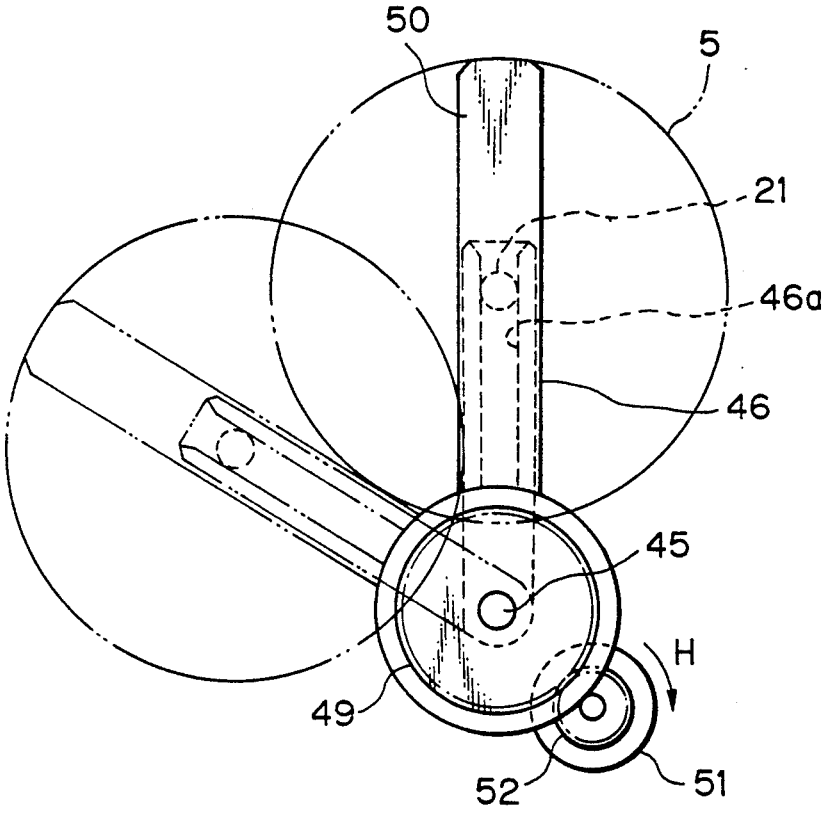
FIG. 6 is a fragmentary view of the mechanism shown in FIG. 5.

FIGS. 5 and 6 show a modified form of the mounting and dismounting mechanism described with reference to FIGS. 4A–4C. As shown, the shaft 45 for rotating the revolver 5 extends throughout front and rear side walls 48*a* and 48*b* of the copier body. The arm members 46 have their lower ends affixed to the shaft 45 at the inside of the side walls 48*a* and 48*b*. A gear 49 and a handle-like member 50 are affixed to the shaft 45 at the outside of the front side wall 48*a*. A rotary oil damper 51 is mounted on the outer surface of the front side wall 48*a*. A gear 52 is mounted on the damper shaft of the oil damper 51 and held in mesh with the gear 49. The oil damper 51 incorporates, for example, a one-way clutch such that a load acts on the oil damper 51, i.e., the oil damper 51 absorbs a torque only in a direction H in which the revolver 5 is mounted. The upper ends of the arm members 46 are engaged with the shaft 21 of the revolver 5. In this configuration, when the handle-like member 50 is rotated by hand, the revolver 5 is moved toward or away from the belt 4. When the revolver 5 is mounted, the oil damper 51 regulates the movement of the revolver although the weight of the revolver 5 acts. Hence, the revolver 5 is moved slowly until it has been stopped by the end of the slot 47*a* of the guide member 47. When the revolver 5 is dismounted, a force great enough to overcome the weight of the revolver 5 is needed. In this case, the oil damper 51 does not exert a load at all due to the one-way mechanism included therein.

Figure 7:
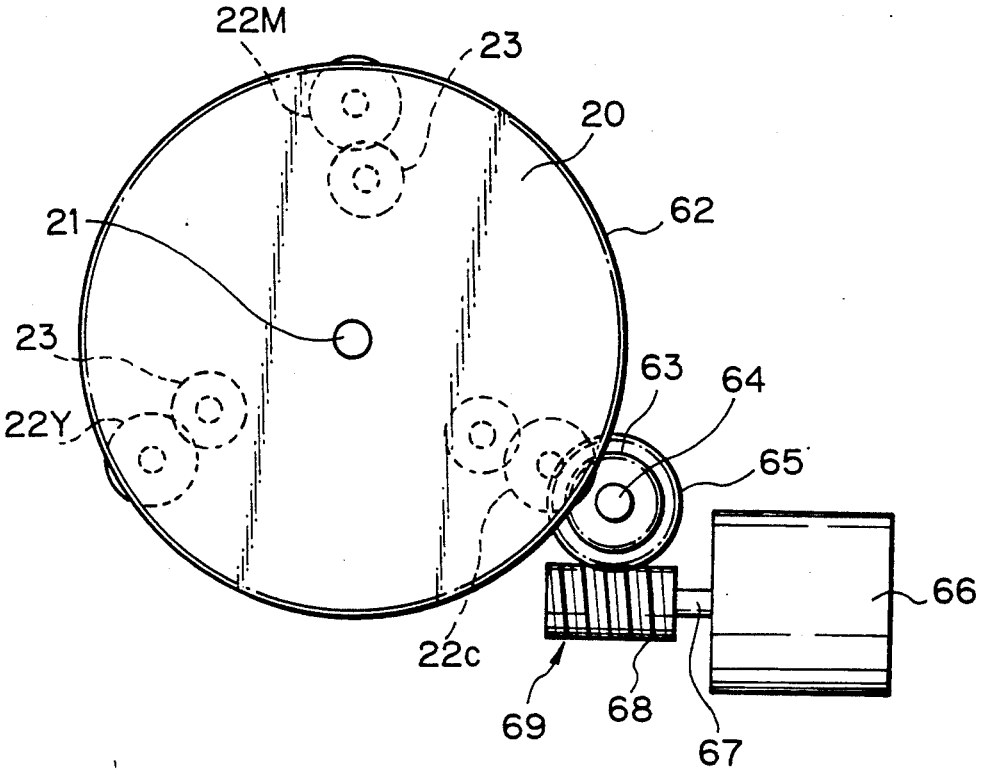
FIG. 7 shows a rotation driveline.
Figure 8:
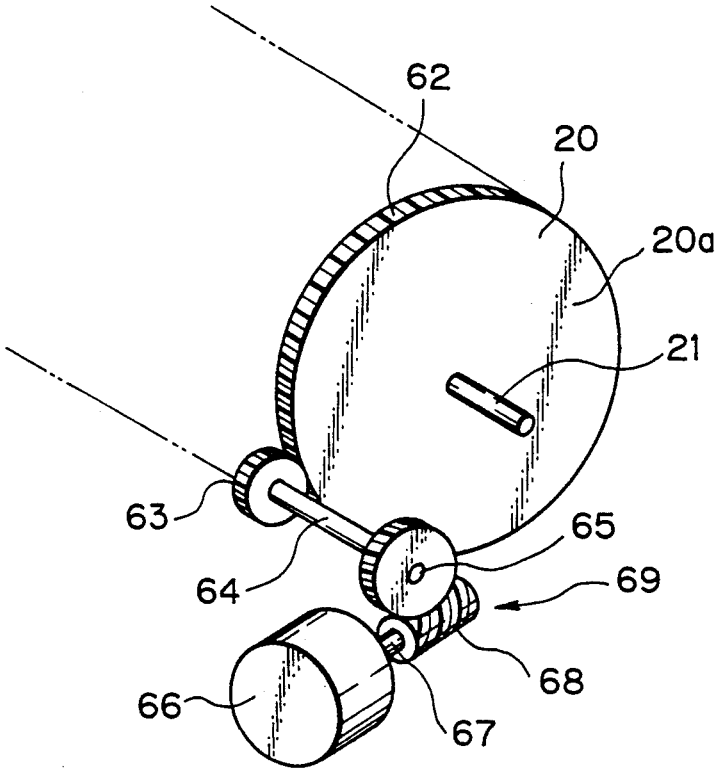
FIG. 8 is a perspective view of the driveline shown in FIG. 7.

A reference will be made to FIGS. 7 and 8 for describing a mechanism for rotating the revolver 5 about the shaft 21. As shown, teeth 62 are provided on the circumference of the casing 20, i.e., a side wall 20*a* of the casing 20. A drive gear 63 is journalled to the copier body to rotate integrally with a shaft 64 and is positioned to mesh with the teeth or gear 62. A worm wheel 65 is rotatable integrally with the shaft 64. A stepping motor or pulse motor 66 plays the role of a drive source for the revolver 5. A worm 68 is mounted on the output shaft 67 of the motor 66 and held in mesh with the worm wheel 65. The worm 68 and worm wheel 65 constitute a one-way transmission mechanism 69 on the drive transmission path. In this embodiment, the worm 68 has a single thread and a lead angle of about 3 degrees while the worm wheel 65 has thirty teeth. The gear 62 of the side wall 20*a* and the drive gear 63 respectively are implemented as a helical gear having 120 teeth and a helix angle of 20 degrees and a helical gear having 20 teeth and a helix angle of 20 degrees. The distance between the gear shafts and the accuracy of tooth configuration are controlled to reduce backlash between the gears.

In the illustrative embodiment, the revolver 5 has three developing units $9_Y$, $9_M$ and $9_C$ accommodating the developing rollers $22_Y$, $22_M$ and $22_C$, respectively. To change the developing color, the revolver 5 is rotated, usually 120 degrees, to bring the developing roller 22 of interest to the developing position and then stopped. Therefore, to select the next color, the gear 62 is rotated forty teeth, i.e., the stepping motor 46 is rotated sixty rotations within a predetermined period of time.

After the revolver 5 has been rotated to and retained at a predetermined reference position or home position by a mechanism, not shown, the stepping motor 66 is caused to rotate a predetermined number of rotations (pulses) and then stop. At this instant, a drive force is acting on the developing roller 22 by a clutch mechanism, not shown, generating a force tending to rotate the revolver 5 in one direction. However, the force tending to rotate the revolver 5 is not transferred to the motor 66 due to the worm 68 and worm wheel 65 disposed on the drive transmission path extending from the motor 66, i.e., due to the relation between the lead angle and the helix angle. It follows that only if the rotation of the motor 66 is stopped, the revolver 5 is prevented from rotating about the shaft 21 and is surely positioned and retained. In addition, the worm 68 and worm wheel 65 allow the rotation of the revolver 5 (casing 20) to be reduced at a great ratio to the rotation of the output shaft of the motor 66. Hence, the motor 65 is used in the high speed and highly efficient range. The motor 65, therefore, can be implemented by a small motor and does not need any extra speed reducer.

While the inertia of the revolver 5 acts when the revolver 5 rotates and stops, it is also absorbed by the above-described arrangement. This allows the revolver 5 to be positioned and retained smoothly and accurately. Further, the stepping motor 66 facilitates the control of rotation speed and, therefore, promotes smooth rotation of the revolver 5, compared to ordinary motors.

On completing a full color or similar sequence of developing steps, the revolver 5 is rotated about the shaft 21 to the previously mentioned home position to wait for the next printing cycle.

Referring to FIGS. 1A–1D and 9, a relation between the revolver 5 and the cover 39 which is the crux of the illustrative embodiment will be described. To begin with, a closure member or shutter 70 is disposed in the cover 39 and rotatable about the shaft 21 to open and close an opening 39*a* formed through the cover 39 in the longitudinal direction. A torsion spring 71 is wound round the shaft 21 and anchored at one end to the cover 39 and at the other end to the shutter 70. The torsion spring 71, therefore, constantly biases the shutter 70 in the direction for closing the opening 39*a*.

Figure 1A:
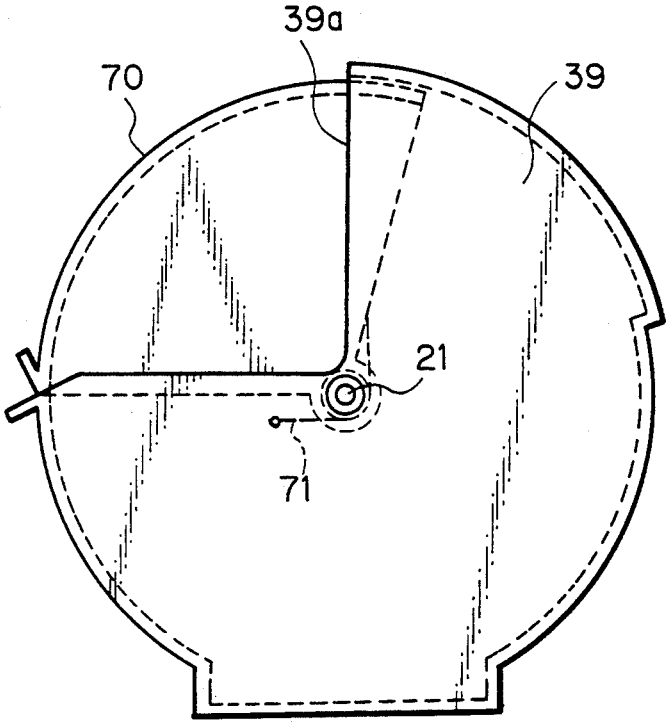
FIGS. 1A-1D are front views each showing a revolver type developing device included in image forming equipment embodying the present invention in a particular condition.
Figure 1B:
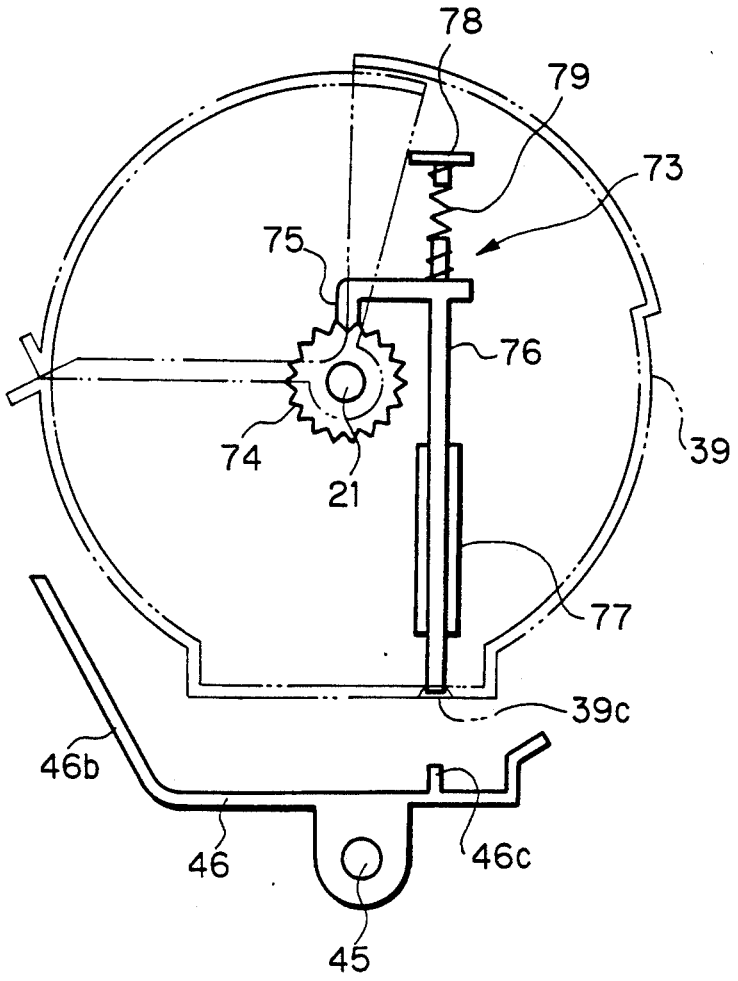
Figure 1C:
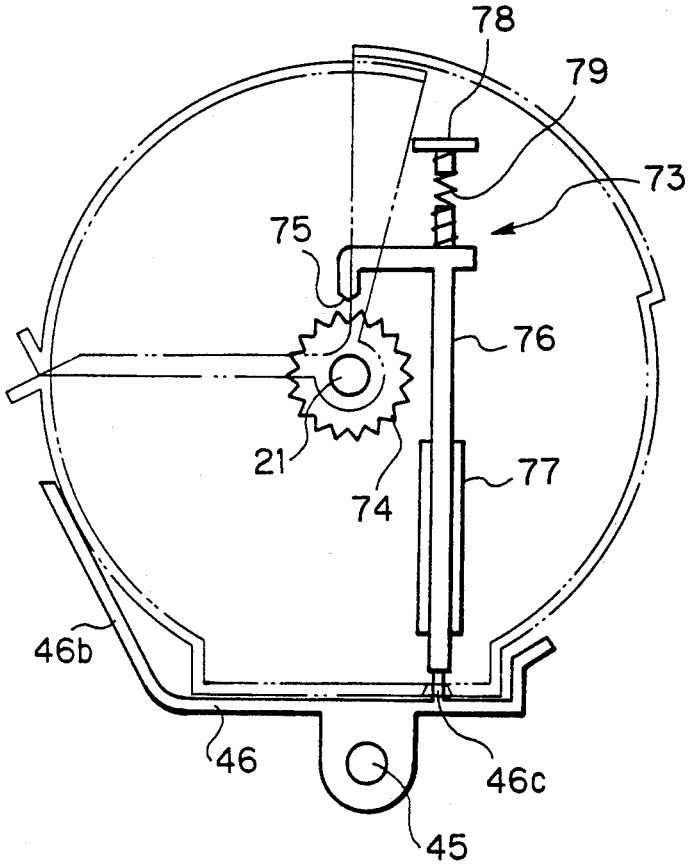
Figure 1D:
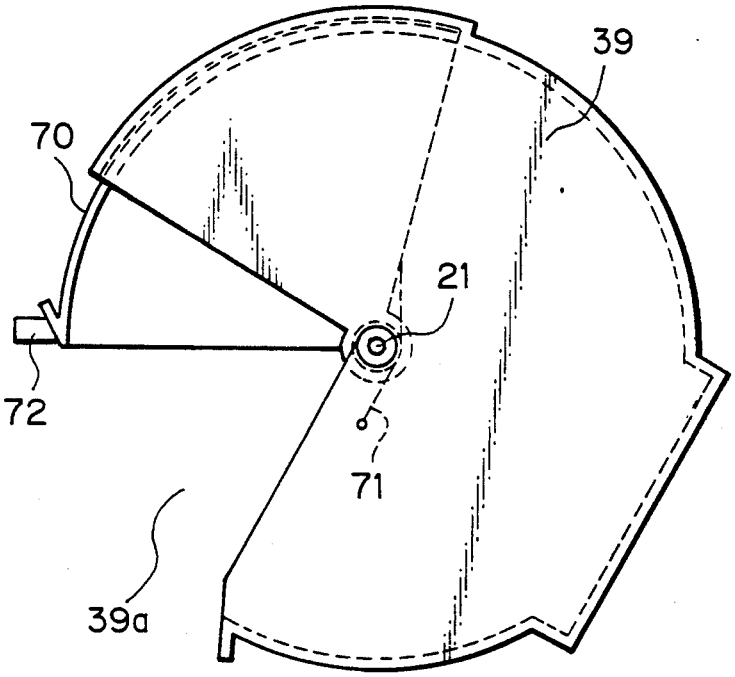

Specifically, when the revolver 5 is set in the copier body, the cover 39 and shutter 70 are positioned as shown in FIG. 1D. As shown, as the lower end of the shutter 70 abuts against a stop 72, the shutter is rotated about the shaft 21 against the force of the torsion spring 71 with the result that the opening 39*a* is uncovered. In this condition, the developing roller 2 is exposed to the outside to effect the previously stated image formation.

When the revolver 5 is removed from the copier body together with the cover 39, it is brought to the condition shown in FIG. 1A. As shown, since the stop 72 does not act on the revolver 5, the shutter 70 automatically closes the opening 39*a* of the cover 39 under the action of the torsion spring 71. Therefore, when the developing units or the revolver 5 is removed from the copier body or stored or transported, the toner particles dropped and deposited on the inner periphery of the cover 39 are prevented from being scattered around via the opening 39*a*. Since the developing roller 22 is concealed by the shutter 70, it is protected from scratches or similar damage. Furthermore, when the revolver 5 is removed from the copier, dust, paper dust and other impurities are prevented from entering the revolver 5 via the opening 39*a*. Otherwise, such impurities would lower image quality.

Figure 9:
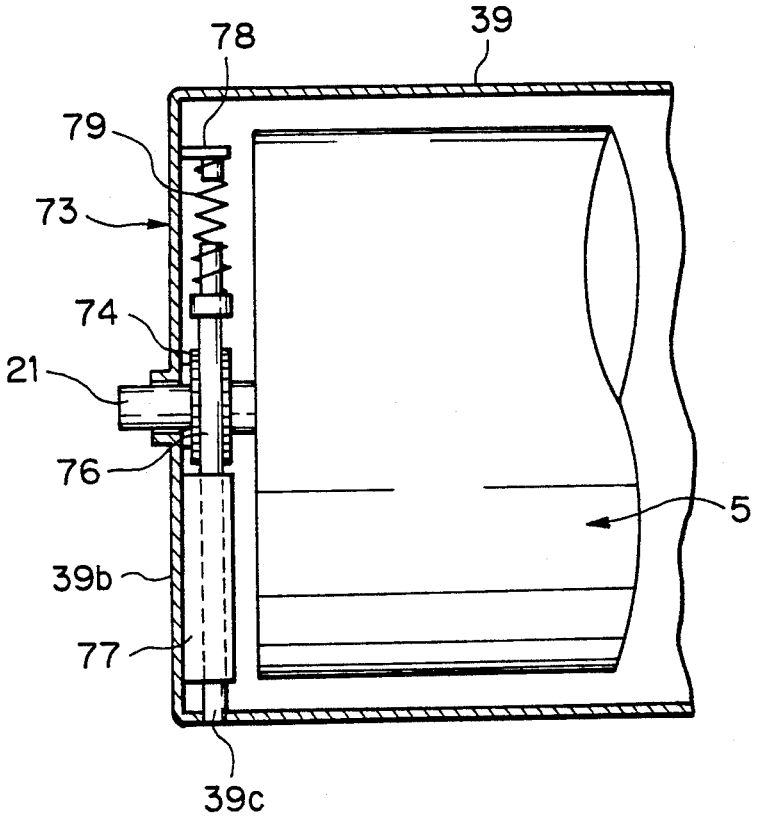
FIG. 9 shows rotation restricting means included in the embodiment.

Further, in the illustrative embodiment, rotation restricting means 73 is located at the inside of the side wall 39*b* of the cover 39 for inhibiting the revolver 5 from rotation. Specifically, as shown in FIG. 9, a gear-like engaging member 74 is mounted on the shaft 21 at the outside of the side wall 20*a* and the inside of the side wall 39*b* (see FIG. 1B). A locking member 76 has an arm 75 which is so bent as to selectively engage with the teeth of the engaging member 74. The locking member 76 is supported by a guide 77 in such a manner as to be slidable into and out of engagement with the engaging member 74. A compression spring 79 is interposed between the locking member 76 and a stop 78 protruding from the inner upper portion of the side wall 39*b*. The compression spring 79 constantly biases the locking member 76 in a direction for causing the arm 75 to mate with the engaging member 74.

As shown in FIGS. 1A and 1B, when the revolver 5 (cover 39) is removed from the copier body, the tip of the arm 75 mates with the teeth of the engaging member 74 due to the force of the compression spring 79. In this condition, the shaft 21 and, therefore, the revolver 5 is prevented from rotating relative to the cover 39. At this instant, the lower end of the locking member 76 is received in a hole 39*c* formed through the bottom of the cover 39.

The previously mentioned auxiliary arm 46*b* extends out from the arm member 46 to sustain the revolver 5. A lug 46*c* is provided on the auxiliary arm 46*b* and so positioned as to enter the hole 39*c* and face the lower end of the locking member 76 when the revolver 5 is mounted on the copier body. As shown in FIGS. 1A and 1B, when the revolver 5 is removed from the copier body, it is prevented from rotating relative to the cover 39. As shown in FIG. 1C, when the revolver 5 is inserted into the copier body to seat on the auxiliary arm 46*b*, the lug 46*c* enters the hole 39*c* and raises the locking member 76 against the action of the spring 79 to release the arm 75 from the teeth of the engaging member 74. As a result, the revolver 5 is allowed to rotate within the cover 39. Subsequently, as the revolver 5 is fully set in the predetermined position shown in FIG. 1D, it is ready to rotate. Then, the previously stated driveline is controlled to execute development.

As stated above, when the developing device or revolver 5 is removed from the copier body or when it is moved toward and away from the operative position within the copier body, the rotation restricting means 73 prevents the revolver 5 from rotating relative to the cover 39. Therefore, when the user or the serviceman removes any developing unit or the like from the copier body for replacement or similar purpose, there is eliminated an occurrence that the revolver 5 drops or contacts the surrounding units due to the shift of the center of gravity thereof. Furthermore, the developing units of the revolver 5 are fixed in place relative to the shaft 21 in the condition occurred just before the removal from the copier body, i.e., in or around the unit reference position or home position. Hence, when the revolver 5 is again inserted into the copier body, the developing units can be moved to their home position easily and rapidly.

A reference will be made to FIGS. 10A and 10B for describing an alternative embodiment of the present invention. As shown, the embodiment has rotation restricting means 80 using the gear 62 of the rotation driveline. Specifically, a locking member 82 is disposed in the cover 39 and rotatably mounted on the bottom of the cover 39 by a support member 81. An arm 82*a* extends from one end of the locking member 82 and moves into and out of engagement with the teeth of the gear 62. A compression spring 83 is loaded between the bottom of the cover 39 and the arm 82*a* of the locking member 82, constantly biasing the tip of the arm 82*a* toward the gear 62. The other end of the locking member 82 is bent downward and can enter the hole 39*c* formed through the cover 39.

Figure 10A:
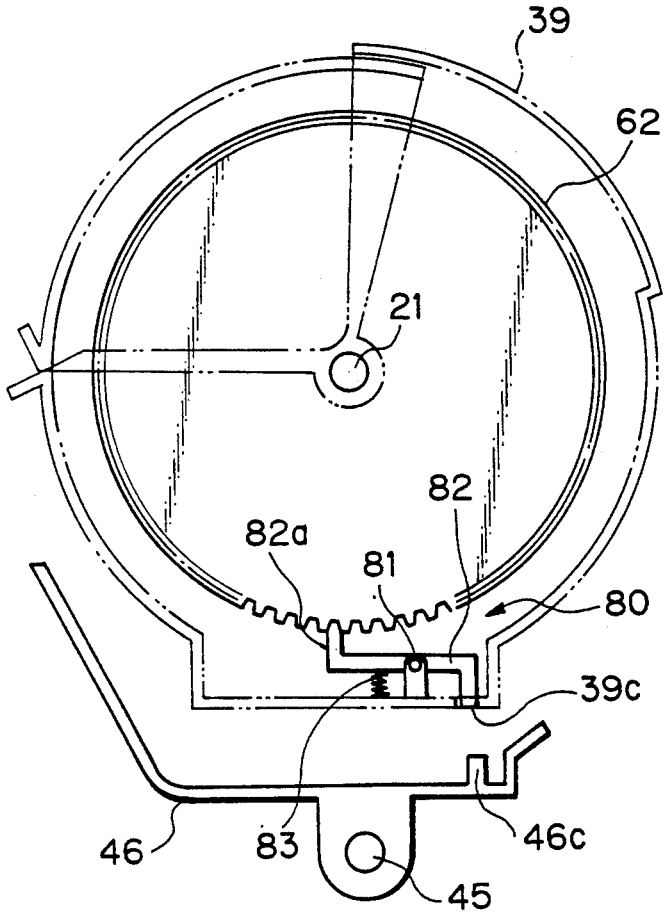
FIGS. 10A and 10B are front views each showing rotation restricting means representative of an alternative embodiment in a particular condition.
Figure 10B:
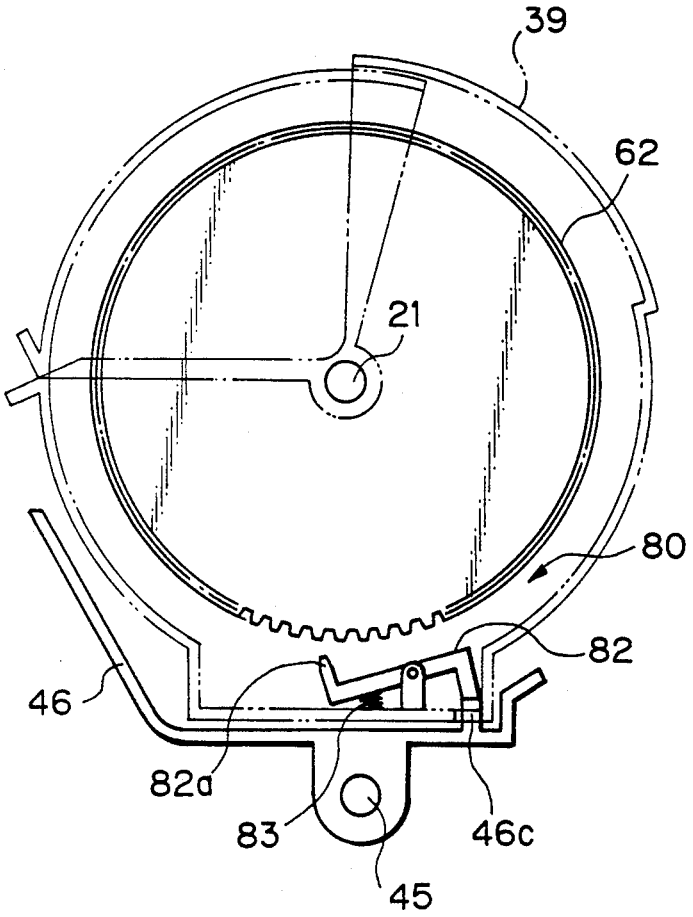

As shown in FIG. 10A, when the revolver 5 is removed or being removed from the copier body, the arm 82*a* of the locking member 82 is held in engagement with the teeth of the gear 62 by the compression spring 83. In this condition, the revolver 5 is prevented from rotating relative to the cover 39. On the other hand, when the revolver 5 is inserted into the copier body, the lug 46*c* of the auxiliary arm 46*b* enters the hole 39*c* of the cover 39, as shown in FIG. 10B. Then, the lug 46*c* raises the other end of the locking member 82 against the action of the compression spring 83. As a result, the arm 82*a* is released from the teeth of the gear 62 to allow the revolver 5 to rotate relative to the cover 39.

Figure 11A:
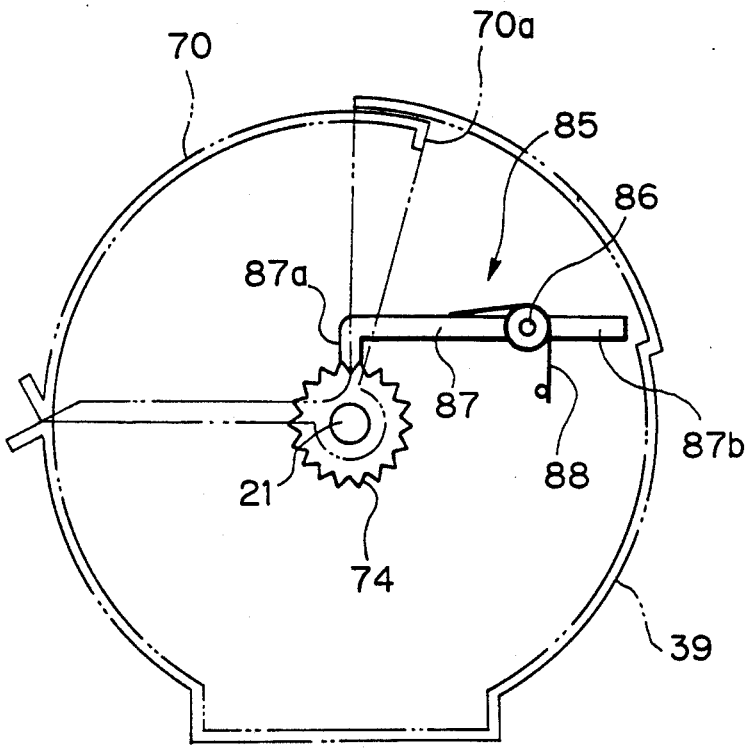
FIGS. 11A and 11B are views similar to FIGS. 10A and 10B, showing another alternative embodiment of the present invention.
Figure 11B:
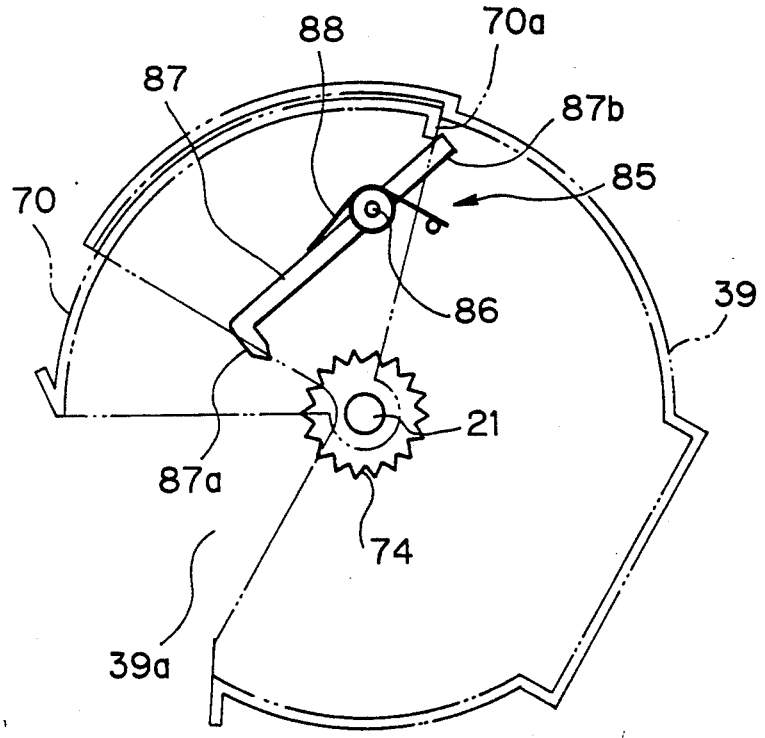

FIGS. 11A and 11B show another alternative embodiment of the present invention. As shown, rotation restricting means 85 is provided which is interlocked with the shutter 70. Specifically, a shaft 86 extends from a predetermined position of the inner surface of the side wall 39*b* of the cover 39. A locking member 87 is rotatably supported by the shaft 86 and provided with a length equal to the radius of the cover 39. An arm 87*a* extends from the inner end of the locking member 87 and moves into and out of engagement with the teeth of the engaging member 74. A torsion spring 88 is wound round the shaft 86 and anchored at one end to the inner surface of the side wall 39*b*, thereby constantly biasing the tip of the arm 87*a* toward the engaging member 74. The outer end of the locking member 87 constitutes a restricting portion 87*b* capable of interfering with a bent end 70*a* included in the shutter 70.

As shown in FIG. 11A, when the revolver 5 with the rotation restricting means 85 is removed or being removed from the copier body, the tip of the arm 87*a* of the locking member 87 is held in engagement with the engaging member 74 by the torsion spring 88. In this condition, the revolver 5 is not rotatable relative to the cover 39. On the other hand, as the revolver 5 is inserted into the copier body, the shutter 70 uncovers the opening 39*a*, as stated earlier. At this instant, as shown in FIG. 11B, the bent end 70*a* of the shutter 70 abuts against and moves the restricting portion 87*b* of the locking member 87 clockwise against the action of the torsion spring 88. As a result, the arm 87*a* is released from the teeth of the engaging member 74 to allow the revolver 5 to rotate.

In summary, it will be seen that the present invention provides image forming equipment in which a revolver type developing device is rotatable relative to a protective member to effect development, but the former is selectively prevented from rotating relative to the latter by rotation restricting means. The equipment is, therefore, free from troubles ascribable to the accidental rotation of the developing device.

At least when the developing device or revolver is fully dismounted from the image forming equipment, it is prevented from rotating. Hence, when the user or the serviceman takes out the revolver from the equipment to, for example, replace developing units, the revolver is prevented from rotating by accident and being brought out of balance.

The revolver is selectively allowed or not allowed to rotate in interlocked relation to the movement thereof into or out of the image forming equipment. The equipment is, therefore, easy to operate and free from troubles ascribable to a complicated and troublesome operation. In addition, when the revolver is removed from the equipment, it is brought to the unrotatable state in a condition occurred just before the removal, i.e., in or around a unit reference position due to the interlocked configuration. Hence, when the revolver is again inserted into the equipment, it can be restored to the unit reference position easily and rapidly.

Moreover, the equipment of the invention has a closure member for selectively opening or closing an opening formed through the protective member in interlocked relation to the movement of the revolver. The revolver is selectively allowed or not allowed to rotate relative to the protective member in association with the movement of the closure member, so that troubles ascribable to the mounting and dismounting of the revolver are surely eliminated.

Various modifications will become possible for those skilled in the art after receiving the teachings of the present disclosure without departing from the scope thereof.

What is claimed is:

1. Image forming equipment comprising:

an image carrier;

a revolver type developing device rotatable about a shaft to bring any one of a plurality of developing units to a developing position where the developing unit faces said image carrier for effecting development;

a protective member rotatably accommodating said developing device therein and having an opening which faces said image carrier at the developing position when said protective member is mounted on said equipment; and rotation restricting means for selectively inhibiting said developing device from rotating relative to said protective member, said rotation restricting means located inside of said protective member.

2. Equipment as claimed in claim 1, wherein said rotation restricting means inhibits said developing device from rotating relative to said protective member at least when said developing device is removed from said equipment.

3. Equipment as claimed in claim 1, wherein said restricting means selectively inhibits said developing device from rotating relative to said protective member in interlocked relation to a movement of said developing device into or out of said equipment.

4. Equipment as claimed in claim 1, further comprising:

a closure member for selectively opening or closing said opening of said protective member in interlocked relation to a movement of said developing device into or out of said equipment;

said restricting means selectively inhibiting said developing device from rotating relative to said protective member in response to a closing movement of said closure member.

5. The image forming equipment of claim 1, wherein said rotation restricting means includes a locking member movable between a first locked position and a second unlocked position, and wherein in said first locked position said locking member mechanically couples said shaft and said protective member thereby preventing relative rotation between said shaft and said protective member, and further wherein in said second unlocked position said locking member is not mechanically coupled to said shaft.

6. The image forming equipment of claim 1, further including a closure member for selectively opening and closing the opening of said protective member, said rotation restricting means including a locking member movable between a first locked position and a second unlocked position, and wherein a portion of said locking member is disposed along a path of movement of a portion of said closure member such that as said closure member is moved from a closed position to an open position said portion of said closure member abuts said portion of said locking member and moves said locking member from said first locked position to said second unlocked position.

7. The image forming equipment of claim 1, wherein said rotation restricting means includes an engaging member disposed on said shaft, and a locking member mounted on said protective member, said locking member movable between a first locked position in which said locking member engages said engaging member to thereby prevent rotation of said developing device, and a second unlocked position at which said locking member is spaced from said engaging member.

8. An image forming apparatus comprising:

an image carrier;

a revolver type developing device rotatable about a shaft to selectively bring one of a plurality of developing units to a developing position where said one of a plurality of developing units faces said image carrier, said revolver type developing device further being movably mounted with respect to said image carrier such that said revolver type developing device is movable between a first operative position at which said revolver type developing device is adjacent said image carrier and a second inoperative position at which said revolver type developing device is spaced from said image carrier;

a protective member rotatably accommodating said developing device therein and having an opening which faces said image carrier at the developing position when said protective member is mounted on said equipment and when said revolver type developing device is in said first operative position;

a movably mounted closure member for selectively opening and closing said opening of said protective member; and locking means for locking said developing device against rotation in response to at least one of: (1) closing of said closure member; and (2) movement of said revolver type developing device from said first operative position to said second inoperative position.

9. An image forming apparatus comprising:

a revolver type developing device rotatable about a shaft to selectively bring one of a plurality of developing units to a developing position;

a protective member rotatably accommodating said developing device therein;

a locking member movable between a first locked position and a second unlocked position, said locking member mechanically coupling said protective member and said shaft in said first locked position, and wherein said locking member is not coupled to said shaft in said second unlocked position.

10. The image forming apparatus of claim 9, wherein said protective member includes an opening, and further wherein a movable closure member is provided for selectively opening and closing said opening, and wherein said locking member includes a portion which is located in a path of a portion of said closure member as said closure member moves from a closed position to an open position such that said portion of said closure member abuts against said portion of said locking member when said closure member is opened to thereby move said locking member to said second unlocked position.

11. The image forming apparatus of claim 9, further including a lug separate from said protective member and extending through a hole in said protective member, said lug engaging said locking member and holding said locking member in said second unlocked position, and further wherein biasing means are provided for urging said locking member into said first locked position, whereby when said revolver type developing device and said protective member are moved relative to said lug said lug releases said locking member such that said locking member is moved into the first locked position by said biasing means.

12. The image forming apparatus of claim 11, wherein said lug is disposed on an arm upon which said revolver type developing device is mounted.

13. The image forming apparatus of claim 9, wherein said locking member engages a gear connected to said shaft when said locking member is in said first locked position.

14. The image forming apparatus of claim 13, wherein said gear is connected to driving means for rotating said revolver type developing device for positioning said plurality of developing units.

15. The image forming apparatus of claim 9, further including an engaging member disposed on said shaft, and wherein when said locking member is in said first locked position said locking member engages said engaging member disposed on said shaft.

16. The image forming apparatus of claim 9, wherein said locking member is mounted on said protective member.

* * * * *

UNITED STATES PATENT AND TRADEMARK OFFICE

CERTIFICATE OF CORRECTION

PATENT NO. : 5,331,390

DATED : July 19, 1994

INVENTOR(S) : Noriyuki KIMURA, et al.

It is certified that error appears in the above-indentified patent and that said Letters Patent is hereby corrected as shown below:

On the title page, Item [75], the 2nd inventor's first name should read as follows:

--Minoru--

Signed and Sealed this

Fourth Day of October, 1994

*Attest:*

*Attesting Officer*

BRUCE LEHMAN

*Commissioner of Patents and Trademarks*